US010883241B2

(12) United States Patent
Chen

(10) Patent No.: US 10,883,241 B2
(45) Date of Patent: Jan. 5, 2021

(54) TRUSS-LIKE HYDRAULIC LIFTING APPARATUS WITH PLUGS

(71) Applicant: XIBOHAN (SHANGHAI) MARINE EQUIPMENT TECHNOLOGY CO. LTD., Shanghai (CN)

(72) Inventor: Yongdong Chen, Shanghai (CN)

(73) Assignee: Xibohan (Shanghai) Marine Equipment Technology Co. Ltd., Shanghai (CN)

( * ) Notice: Subject to any disclaimer, the term of this patent is extended or adjusted under 35 U.S.C. 154(b) by 70 days.

(21) Appl. No.: 16/319,887

(22) PCT Filed: Apr. 3, 2018

(86) PCT No.: PCT/CN2018/081718

§ 371 (c)(1),
(2) Date: Jan. 23, 2019

(87) PCT Pub. No.: WO2019/033765

PCT Pub. Date: Feb. 21, 2019

(65) Prior Publication Data

US 2020/0240098 A1 Jul. 30, 2020

(30) Foreign Application Priority Data

Aug. 17, 2017 (CN) ..... 2017 1 0707715

(51) Int. Cl.
*E02B 17/08* (2006.01)

(52) U.S. Cl.
CPC ..... *E02B 17/0809* (2013.01)

(58) Field of Classification Search
CPC combination set(s) only.
See application file for complete search history.

(56) References Cited

U.S. PATENT DOCUMENTS 4,199,276 A * 4/1980 Molsberger ..... E02B 17/0872 405/198
5,701,649 A * 12/1997 Reesor ..... B25B 27/023 29/252

(Continued)

FOREIGN PATENT DOCUMENTS

CN 105442518 3/2016
CN 105696539 6/2016

(Continued)

*Primary Examiner* — Kyle Armstrong
(74) *Attorney, Agent, or Firm* — Sand, Sebolt & Wernow Co., LPA

(57) ABSTRACT

A truss-like hydraulic lifting apparatus with plugs including a pile reinforcing frame, a truss structure extending through and mounted within the pile reinforcing frame and a first number of uniformly disposed support legs, each having a support leg inserting hole. A first number of power source devices each has a plug corresponding to the support leg inserting hole. A detachable mechanism is provided for detachably fixing each of the power source devices to the pile reinforcing frame. The detachable mechanism includes a base plate laterally fixed relative to the pile reinforcing frame and having an opening through which the support leg vertically passes and forms a protective cap above the power source device. The lateral dimension of the protective cap is larger than the lateral dimension of the power source device.

11 Claims, 3 Drawing Sheets

(56) References Cited

U.S. PATENT DOCUMENTS

| | | | | |
|---|---|---|---|---|
| 10,011,467 | B1 * | 7/2018 | Perry | E02B 17/021 |
| 2011/0211915 | A1 * | 9/2011 | Van Nood | E02B 17/0809 405/197 |

FOREIGN PATENT DOCUMENTS

| | | |
|---|---|---|
| CN | 205475170 | 8/2016 |
| CN | 106592560 | 4/2017 |
| CN | 107386244 | 11/2017 |
| JP | 2017053095 | 3/2017 |
| JP | 2017077738 | 4/2017 |
| WO | 2017039527 | 3/2017 |

* cited by examiner

TRUSS-LIKE HYDRAULIC LIFTING APPARATUS WITH PLUGS

TECHNICAL FIELD

Embodiments of the present invention relate to the technical field of marine platform apparatuses, and in particular, to a truss-like hydraulic lifting apparatus with plugs.

BACKGROUND

With the exploration and development of marine resources, more and more marine platforms are constructed. In the coastal and even medium-depth and deep-sea areas, a jack-up platform has been widely used for its advantages such as continuous operation, stable working and high efficiency in various sea conditions, and thus it is the main platform in the sea areas. A platform lifting apparatus is the key to the jack-up platform and is highly valued in design and construction. The current lifting apparatus is generally in the form of either a plug-type lifting apparatus or a gear-type lifting apparatus. The truss-type leg is usually used together with a pinion-rack lifting apparatus, but the conventional rack truss-type leg has a high manufacturing cost due to high requirements on the quality and precision of the rack and the difficulty in welding. The welding accuracy and quality control of the rack and the main chord tube for the leg are also major difficulties in the manufacturing process of the leg. Therefore, the plug-type lifting apparatus is used more commonly.

However, inventors found in the long-term practice and research that, the power source device of the existing plug-type lifting apparatus is fixedly mounted and is inconvenient to be disassembled, which is not conducive to the maintenance during the later use. Furthermore, the power source device is extremely susceptible to extrinsic damages, which will cause serious loss.

SUMMARY

Embodiments of the present invention provide a truss-like hydraulic lifting apparatus with plugs, in order to solve at least the technical problem in the above-described technical problems that the truss-like hydraulic lifting apparatus with plugs is inconvenient to be disassembled for maintenance.

In some embodiments of the truss-like hydraulic lifting apparatus with plugs of the present invention, the truss-like hydraulic lifting apparatus includes: a pile reinforcing frame;

a truss structure extending through and mounted within the pile reinforcing frame, wherein the truss structure includes a first number of uniformly disposed support legs, and each of the support legs is provided with a support leg inserting hole;

a first number of power source devices each provided with a plug corresponding to the support leg inserting hole of each of the support legs;

a detachable mechanism for detachably fixing each of the power source devices to the pile reinforcing frame, wherein the detachable mechanism includes:

a base plate laterally fixed relative to the pile reinforcing frame, which is provided with an opening through which the support leg vertically passes and forms a protective cap above the power source device, wherein the lateral dimension of the protective cap is larger than the lateral dimension of the power source device.

With the truss-like hydraulic lifting apparatus with plugs in this embodiment, the power source device is detachably fixed to the pile reinforcing frame via the detachable mechanism, so that the power source device may be conveniently dismounted, and thus a power source device in malfunction may be dismounted for inspection and maintenance, which reduces the degree of difficulty in maintenance and ensures the safety of maintenance personnel (in view of that the apparatus of the present invention is used for marine platforms, and is either in sea water or much high above the sea level). On the other hand, after a lifting task is completed, the power source device may be disassembled and stored to prevent the power source device from being damaged by external factors, which extends the service life of the equipment and reduces the production cost. Alternatively, after the lifting task is completed, the power source device may be mounted to other truss-like hydraulic lifting apparatus with plugs that needs to perform a lifting operation, so that the power source device is made full use through sharing, which saves the cost of re-configuring the power source device. Alternatively, since the fixed base plate forms the protective cap above the power source device, the power source device is prevented from being damaged by the impact caused by the gravity acceleration of the object falling from above, thus protecting the power source device.

In some embodiments, the base plate may be detachably mounted on the pile reinforcing frame via a plug structure, a mounting plug hole may be arranged on the base plate, and the pile reinforcing frame is provided with a mounting plug corresponding to the mounting plug hole.

In some embodiments, a plug cylinder may be disposed on the pile reinforcing frame for driving the mounting plug to be automatically inserted and removed.

In some embodiments, the base plate is detachably mounted on the pile reinforcing frame via a tenon-mortise structure, a tenon is provided on each of two ends of the base plate connected with the pile reinforcing frame, and the pile reinforcing frame is provided with a mortise corresponding to the tenon.

In some embodiments, the power source device may comprise an upper cylinder assembly and a lower cylinder assembly which are mounted on the base plate, respectively. The upper cylinder assembly may comprise a first upper cylinder and a second upper cylinder whose upper ends are connected to the base plate, and an upper slider which is connected to the lower ends of the first upper cylinder and the second upper cylinder. The lower cylinder assembly may comprise a first lower cylinder and a second lower cylinder whose upper ends are connected to the base plate, and a lower slider which is connected to the lower ends of the first lower cylinder and the second lower cylinder.

In some embodiments, the upper ends of the first upper cylinder and the second upper cylinder may be first type T-shaped ends, with first type T-shaped end joint ports corresponding to the first type T-shaped ends being arranged on the base plate, and the first upper cylinder and the second upper cylinder are respectively mounted on the first type T-shaped end joint ports of the base plate via the upper ends of the first type T-shaped ends. The upper ends of the first lower cylinder and the second lower cylinder are second type T-shaped ends, with second type T-shaped end joint ports corresponding to the second type T-shaped ends being arranged on the base plate, and the first lower cylinder and the second lower cylinder are respectively mounted on the second type T-shaped end joint ports of the base plate via the upper ends of the second type T-shaped ends.

In some embodiments, the first upper cylinder and the second upper cylinder are symmetrically distributed on two sides of the corresponding support leg, and the first lower cylinder and the second lower cylinder are symmetrically placed on two sides of the corresponding support leg. U-shaped openings are arranged respectively on the upper slider and the lower slider for receiving the corresponding support leg, and the upper slider and the lower slider are respectively provided with the plug.

In some embodiments, the pile reinforcing frame may further comprise limiting members symmetrically provided on two sides of the support leg, wherein the limiting member is parallel to the extending direction of the support leg, and a limiting hole is arranged on the limiting member which is in one-to-one correspondence with the support leg inserting hole on the support leg for limiting the pile reinforcing frame when a limiting plug is inserted into the limiting hole and the corresponding support leg inserting hole, and for carrying the pile reinforcing frame.

In some embodiments, the distance between the limiting members is less than the opening width of the U-shaped opening.

In some embodiments, the truss structure is a triangular truss structure, the first number of support legs comprises three support legs, and the first number of power source devices comprises three power source devices.

BRIEF DESCRIPTION OF THE DRAWINGS

In order to more clearly illustrate the embodiments of the present invention or prior art, figures to be used in the embodiments or prior art will be briefly introduced in the following. Apparently, figures in the following description are some embodiments of the present invention, and other figures can be obtained by those skilled in the art based on these figures without inventive efforts.

DETAILED DESCRIPTION

To make the objectives, technical solutions, and advantages of the embodiments of the disclosure more clear, the following will clearly and completely describe the embodiments of the disclosure with reference to the drawings. Obviously, the described embodiments are merely part of the embodiments of the disclosure, but do not encompass all possible embodiments. Other embodiments obtained by the ordinary skill in the art based on the description provided in the disclosure fall within the scope of the disclosure.

It should also be noted that, embodiments of the present application and the technical features involved therein may be combined with each other in case they are not conflict with each other. The present invention will now be illustrated with reference to the accompanied figures in conjunction with various embodiments.

Figure 1:
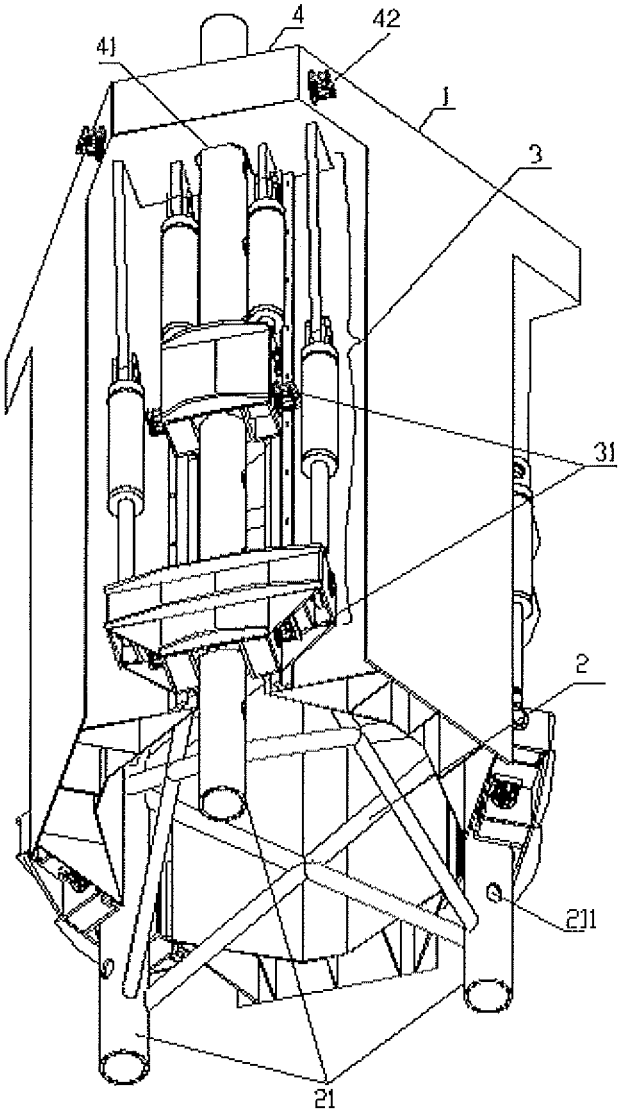
FIG. 1 is a schematic structural view of one embodiment of the truss-like hydraulic lifting apparatus with plugs according to the present invention.

As shown in FIG. 1, in some embodiments of the present invention, the truss-like hydraulic lifting apparatus with plugs includes a pile reinforcing frame 1, and a truss structure 2 extending through and mounted within the pile reinforcing frame 1. The truss structure 2 includes a first number of uniformly disposed support legs 21. Each of the support legs 21 is provided with a support leg inserting hole 211.

The truss-like hydraulic lifting apparatus further includes a first number of power source devices 3 each provided with a plug 31 corresponding to the support leg inserting hole 211 of each of the support legs 21, and a detachable mechanism for detachably fixing each of the power source devices 3 to the pile reinforcing frame 1. The detachable mechanism includes a base plate 4 which is laterally fixed relative to the pile reinforcing frame 1. An opening 41 through which the support leg vertically passes is provided on the base plate 4 that forms a protective cap above the power source device 3. The lateral dimension of the protective cap is larger than the lateral dimension of the power source device 3.

With respect to the truss-like hydraulic lifting apparatus with plugs in this embodiment, the power source device 3 is detachably fixed to the pile reinforcing frame 1 via the detachable mechanism, so that the power source device 3 may be conveniently detached, and thus when the power source device 3 fails, it may be dismounted for inspection and maintenance, which reduces the degree of difficulty in maintenance and ensures the safety of maintenance personnel (considering that the apparatus of the present invention is used for marine platforms, which is either in sea water or much high above the sea level). On the other hand, after a lifting task is completed, the power source device 3 may be dismounted and stored to prevent the power source device 3 from being damaged by external factors, which prolong the service life of the power source device and reduces the production cost. Alternatively, after the lifting task is completed, the power source device may be mounted to other truss-like hydraulic lifting apparatus with plugs that needs to perform a lifting operation, so that the power source device 3 is fully utilized by sharing, which saves the cost of re-configuring the power source device 3. Moreover, since the fixed base plate 4 forms the protective cap above the power source device 3, the power source device 3 is prevented from being damaged by the impact caused by the gravity acceleration of the object falling from above, thus protecting the power source device 3.

In some embodiments, the base plate 4 is detachably mounted on the pile reinforcing frame 1 via a plug structure, a mounting plug hole is arranged on the base plate 4, and the pile reinforcing frame 1 is provided with a mounting plug 42 corresponding to the mounting plug hole. A plug cylinder is disposed on the pile reinforcing frame 1 for driving the mounting plug 42 to be automatically inserted and removed. In this embodiment, the detachable mounting of the base plate 4 and the pile reinforcing frame 1 is realized by the plug structure, and the automatic disassembly and assembly of the base plate 4 is realized through cooperating with the plug cylinder, thereby reducing the participation of personnel and reducing the operation burden.

In some embodiments, the base plate 4 is detachably mounted on the pile reinforcing frame via a tenon-mortise structure, a tenon is provided on each of two ends of the base plate connected with the pile reinforcing frame, and the pile reinforcing frame 1 is provided with a mortise corresponding to the tenon. In this embodiment, the detachable mounting of the base plate 4 and the pile reinforcing frame 1 is realized by the tenon-mortise structure, which simplifies the structure by not requiring separate provision of any components for mounting and connection. It is only necessary to provide a tenon on the joint portion of the base plate 4 and to provide a mortise in the corresponding portion of the pile reinforcing frame 1.

Figure 2:
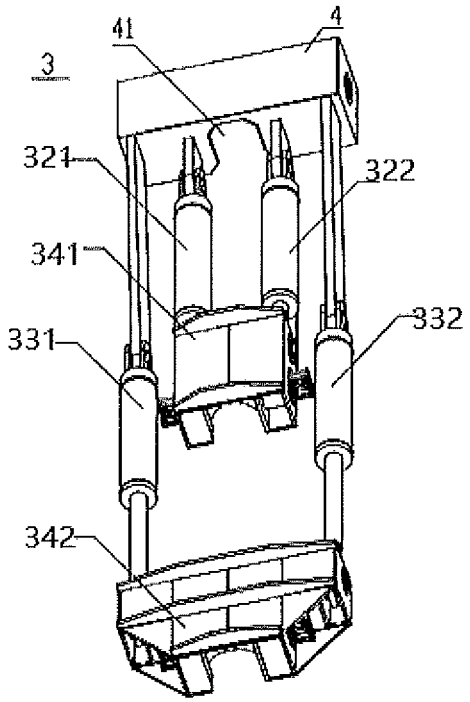
FIG. 2 is a schematic structural view of one embodiment of the mounting mode of the detachable mechanism and the power source device in the truss-like hydraulic lifting apparatus with plugs according to the present invention.

As shown in FIG. 2, in some embodiments, the power source device 3 includes an upper cylinder assembly and a lower cylinder assembly which are mounted on the base plate 4, respectively. The upper cylinder assembly includes a first upper cylinder 321 and a second upper cylinder 322 whose upper ends are connected to the base plate 4, and an upper slider 341 which is connected to the lower ends of the first upper cylinder 321 and the second upper cylinder 322. The upper ends of the first upper cylinder 321 and the second upper cylinder 322 may be directly welded to the lower surface of the base plate 4. In particular, an ear plate is welded to the lower surface of the base plate 4, and the upper ends of the first upper cylinder 321 and the second upper cylinder 322 are fixedly connected to the base plate 4 via the ear plate. The upper ends of the first upper cylinder 321 and the second upper cylinder 322 are detachably mounted on the base plate 4. The upper ends of the first upper cylinder 321 and the second upper cylinder 322 are movably connected to the base plate 4 via a tenon-mortise structure or a plug structure. For example, the tenon-mortise structure is configured such that the upper ends of the first upper cylinder 321 and the second upper cylinder 322 are respectively provided with a tenon, and a corresponding mortise is provided on the base plate 4.

The lower cylinder assembly includes a first lower cylinder 331 and a second lower cylinder 332 whose upper ends are connected to the base plate 4, and a lower slider 342 which is connected to the lower ends of the first lower cylinder 331 and the second lower cylinder 332. The upper ends of the first lower cylinder 331 and the second lower cylinder 332 may be directly welded to the lower surface of the base plate 4. An ear plate is welded to the lower surface of the base plate 4, and upper ends of the first lower cylinder 331 and the second lower cylinder 332 are fixedly connected to the base plate 4 via the ear plate. The upper ends of the first lower cylinder 331 and the second lower cylinder 332 are detachably mounted on the base plate 4. The upper ends of the first lower cylinder 331 and the second lower cylinder 332 are movably connected to the base plate 4 via a tenon-mortise structure or a plug structure. For example, the tenon-mortise structure is configured such that the upper ends of the first lower cylinder 331 and the second lower cylinder 332 are respectively provided with a tenon, and a corresponding mortise is provided on the base plate 4.

Figure 3:
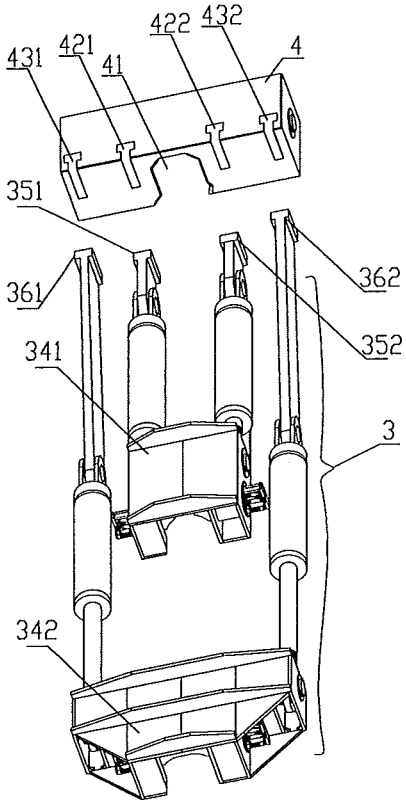
FIG. 3 is a schematic structural view showing the connection between the detachable mechanism and the power source device in the truss-like hydraulic lifting apparatus with plugs according to the present invention.

As shown in FIG. 3, in some embodiments, the tenon-mortise structure between the upper ends of the first upper cylinder 321 and the second upper cylinder 322 and the base plate 4 may be configured such that the upper ends of the first upper cylinder and the second upper cylinder are first type T-shaped ends 351, 352. First type T-shaped end joint ports 421, 422 corresponding to the first type T-shaped ends are arranged on the base plate. The first upper cylinder and the second upper cylinder are respectively mounted on the first type T-shaped end joint ports 421, 422 of the base plate via the upper ends of the first type T-shaped ends 351, 352.

In some embodiments, the tenon-mortise structure between the upper ends of the first lower cylinder 331 and the second lower cylinder 332 and the base plate 4 may be configured such that the upper ends of the first lower cylinder 331 and the second lower cylinder 332 are second type T-shaped ends 361, 362. Second type T-shaped end joint ports 431, 432 corresponding to the second type T-shaped ends are arranged on the base plate. The first lower cylinder 331 and the second lower cylinder 332 are respectively mounted on the second type T-shaped end joint ports 431, 432 of the base plate via the upper ends of the second type T-shaped ends 361, 362.

In the above embodiments, the flexibility of maintaining the power source device is increased by providing the detachable mounting between the upper cylinder assembly and the lower cylinder assembly and the base plate 4. For example, when only one of the upper cylinder assembly and the lower cylinder assembly fails, it is only necessary to separately dismount the failed assembly for inspection and maintenance, without dismounting the entire power source device, which avoids unnecessary duplication of work, and also avoids unnecessary wear and even damage to the cylinder assembly during disassembly.

In some embodiments, the first upper cylinder 321 and the second upper cylinder 322 are symmetrically distributed on two sides of the corresponding support leg 21, and the first lower cylinder 331 and the second lower cylinder 332 are symmetrically distributed on two sides of the corresponding support leg 21. A U-shaped opening is respectively arranged on the upper slider 341 and the lower slider 342 for receiving the corresponding support leg 21. The upper slider 341 and the lower slider 342 are respectively provided with plugs 31 (including an upper plug and a lower plug). In some embodiments, the truss structure is a triangular truss structure, the first number of support legs includes three support legs, and the first number of power source devices includes three power source devices.

Thus, three upper sliders 341 are connected to the pile reinforcing frame 1 via six upper cylinders, and three lower sliders 342 are connected to the pile reinforcing frame 1 via six lower cylinders. When the platform is raised, the upper cylinders are in the shortest stroke state. The upper plug is inserted into the support leg inserting hole 211, and the lower plug is extracted from the support leg inserting hole 211. The cylinders are raised to retract to the shortest stroke, and the lower plug is inserted and the upper plug is extracted. The lower slider is raised and the cylinders are extended, and thus the platform is raised. After completing one pitch (the distance between two adjacent support leg inserting holes 211), the upper plug is inserted and the lower plug is extracted, the cylinder is retracted to the shortest stroke. The above operations are repeated to reach the goal of raising the platform. When the platform is lowered, the lower plug is inserted into the support leg inserting hole 211, and the upper plug is extracted from the support leg inserting hole 211. After the cylinders are extended to one support leg pitch, the lower plug is inserted into the support leg inserting hole 211, and the upper plug is extracted from the support leg inserting hole 211. The above operations are repeated to reach the goal of lowering the platform. By pre-pressing, the pile pulling can be achieved by synchronously lifting and retracting the upper and lower cylinders, and pile impacting and pulling can be achieved by synchronously compressing the upper and lower cylinders.

In some embodiments, the upper slider is connected to the pile reinforcing frame via six cylinders, and six sets of plug devices are provided on the upper slider and the lower slider. When ready for lifting the platform by releasing the pile, the upper and lower cylinders are in a protruding state. During operation, the upper plug is extracted and the cylinders are retracted to the shortest stroke without load. At the same time, the lower cylinders protrude, and the leg is lowered by the plug until the lower cylinders protrude to the longest state. At this point, the upper plug is inserted and the lower plug is extracted, and the upper cylinders drive the leg to finish one pitch, and the cylinders are retracted without load to finish one pitch. The above operations are repeated in this way to realize continuous self-raising of the platform. When the platform is lowered, the operations take place reversely.

In some embodiments, the pile reinforcing frame 1 further includes limiting members symmetrically provided on two sides of the support leg 21. The limiting member is parallel to the extending direction of the support leg 21, and a limiting hole is arranged on the limiting member, which is in one-to-one correspondence with the support leg inserting hole on the support leg 21 for limiting the pile reinforcing frame 1 when a limiting plug is inserted into the limiting hole and the corresponding support leg inserting hole, and for carrying the pile reinforcing frame 1.

In this embodiment, the limiting member may be provided to limit the pile reinforcing frame in any raising position (the power source device realizes the elevating of the pile reinforcing frame), and to release the power source device so that the power source device can be arbitrarily dismounted. For example, after the truss-like hydraulic lifting apparatus with plugs in the embodiment of the present invention is raised to a target height through the pushing action of the power source device, a limiting plug can be inserted into the support leg inserting hole corresponding to the limiting hole to limit the pile reinforcing frame and to control the cylinder assemblies of the power source device to extend to a natural state (a state in which it is not subjected to a pressure, thereby transferring all of the pressure to the limiting plug and the limiting member), so that the power source device can be freely dismounted, which facilitates maintenance and repairing of the power source device. Furthermore, even when the power source device is not required to be dismounted, the power source device may be in a natural state in which it is not subjected to an external force by the action of the limiting member, thereby obtaining the beneficial effects of reducing the working intensity, reducing wear, prolonging the life of the power source device, reducing the cost of equipment maintenance and repair, and reducing the cost of equipment.

Finally, it should be noted that, the above embodiments are merely provided for describing the technical solutions of the present invention, but not intended as a limitation. Although the present invention has been described in detail with reference to the embodiments, those skilled in the art will appreciate that the technical solutions described in the foregoing various embodiments can still be modified, or some technical features therein can be equivalently replaced. Such modifications or replacements do not make the essence of corresponding technical solutions depart from the spirit and scope of technical solutions embodiments of the present invention.

The invention claimed is:

1. A truss-like hydraulic lifting apparatus with plugs, comprising:

a pile reinforcing frame;

a truss structure extending through and mounted within the pile reinforcing frame, wherein the truss structure comprises a first number of uniformly disposed support legs, and each of the support legs is provided with a support leg inserting hole;

a first number of power source devices each provided with a plug corresponding to a support leg inserting hole of each of the support legs;

a detachable mechanism for detachably fixing each of the power source devices to the pile reinforcing frame, wherein the detachable mechanism comprises:

a base plate which is laterally fixed relative to the pile reinforcing frame, is provided with an opening through which the support leg vertically passes, and forms a protective cap above the power source device, wherein the lateral dimension of the protective cap is larger than the lateral dimension of the power source device, and a) wherein in an option A, the base plate is detachably mounted on the pile reinforcing frame via a plug structure, with a mounting plug hole being arranged on the base plate, and the pile reinforcing frame is provided with a mounting plug corresponding to the mounting plug hole; or b) wherein in an option B, the base plate is detachably mounted on the pile reinforcing frame via a tenon-mortise structure in which a tenon is provided on each of two ends of the base plate connected with the pile reinforcing frame.

2. The truss-like hydraulic lifting apparatus with plugs according to claim 1, option A, wherein a plug cylinder is disposed on the pile reinforcing frame for driving the mounting plug to be automatically inserted and removed.

3. The truss-like hydraulic lifting apparatus with plugs according to claim 2, wherein the power source device comprises an upper cylinder assembly and a lower cylinder assembly which are mounted on the base plate, respectively, wherein the upper cylinder assembly comprises a first upper cylinder and a second upper cylinder whose upper ends are connected to the base plate, and an upper slider which is connected to the lower ends of the first upper cylinder and the second upper cylinder; and the lower cylinder assembly comprises a first lower cylinder and a second lower cylinder whose upper ends are connected to the base plate, and a lower slider which is connected to the lower ends of the first lower cylinder and the second lower cylinder.

4. The truss-like hydraulic lifting apparatus with plugs according to claim 3, wherein the upper ends of the first upper cylinder and the second upper cylinder are first type T-shaped ends, first type T-shaped end joint ports corresponding to the first type T-shaped ends are arranged on the base plate, and the first upper cylinder and the second upper cylinder are respectively mounted on the first type T-shaped end joint ports of the base plate via the upper ends of the first type T-shaped ends;

the upper ends of the first lower cylinder and the second lower cylinder are second type T-shaped ends, second type T-shaped end joint ports corresponding to the second type T-shaped ends are arranged on the base plate, and the first lower cylinder and the second lower cylinder are respectively mounted on the second type T-shaped end joint ports of the base plate via the upper ends of the second type T-shaped ends.

5. The truss-like hydraulic lifting apparatus with plugs according to claim 2, wherein the truss structure is a triangular truss structure, in which the first number of support legs comprises three support legs, and the first number of power source devices comprises three power source devices.

6. The truss-like hydraulic lifting apparatus with plugs according to claim 1, wherein the power source device comprises an upper cylinder assembly and a lower cylinder assembly which are mounted on the base plate, respectively, wherein the upper cylinder assembly comprises a first upper cylinder and a second upper cylinder whose upper ends are connected to the base plate, and an upper slider which is connected to the lower ends of the first upper cylinder and the second upper cylinder; and the lower cylinder assembly comprises a first lower cylinder and a second lower cylinder whose upper ends are connected to the base plate, and a lower slider which is connected to the lower ends of the first lower cylinder and the second lower cylinder.

7. The truss-like hydraulic lifting apparatus with plugs according to claim 6, wherein the upper ends of the first upper cylinder and the second upper cylinder are first type T-shaped ends, first type T-shaped end joint ports corresponding to the first type T-shaped ends are arranged on the base plate, and the first upper cylinder and the second upper cylinder are respectively mounted on the first type T-shaped end joint ports of the base plate via the upper ends of the first type T-shaped ends;

the upper ends of the first lower cylinder and the second lower cylinder are second type T-shaped ends, second type T-shaped end joint ports corresponding to the second type T-shaped ends are arranged on the base plate, and the first lower cylinder and the second lower cylinder are respectively mounted on the second type T-shaped end joint ports of the base plate via the upper ends of the second type T-shaped ends.

8. The truss-like hydraulic lifting apparatus with plugs according to claim 1, option A, wherein the first upper cylinder and the second upper cylinder are symmetrically distributed on two sides of the corresponding support leg, and the first lower cylinder and the second lower cylinder are symmetrically distributed on two sides of the corresponding support leg; a U-shaped opening is arranged respectively on the upper slider and the lower slider for receiving the corresponding support leg, and the upper slider and the lower slider are respectively provided with the plug.

9. The truss-like hydraulic lifting apparatus with plugs according to claim 8, wherein the pile reinforcing frame further comprises limiting members symmetrically provided on two sides of the support leg, wherein the limiting member is parallel to the extending direction of the support leg, and a limiting hole is arranged on the limiting member which is in one-to-one correspondence with the support leg inserting hole on the support leg for limiting the pile reinforcing frame and carrying the pile reinforcing frame when a limiting plug is inserted into the limiting hole and the corresponding support leg inserting hole.

10. The truss-like hydraulic lifting apparatus with plugs according to claim 9, wherein the distance between the limiting members is smaller than the opening width of the U-shaped opening.

11. The truss-like hydraulic lifting apparatus with plugs according to claim 1, wherein the truss structure is a triangular truss structure, in which the first number of support legs comprises three support legs, and the first number of power source devices comprises three power source devices.

* * * * *